US012336630B1

(12) United States Patent
Majors

(10) Patent No.: US 12,336,630 B1
(45) Date of Patent: Jun. 24, 2025

(54) CORNER SHELF

(71) Applicant: Bart Majors, Hattiesburg, MS (US)

(72) Inventor: Bart Majors, Hattiesburg, MS (US)

( * ) Notice: Subject to any disclaimer, the term of this patent is extended or adjusted under 35 U.S.C. 154(b) by 0 days.

(21) Appl. No.: 18/753,492

(22) Filed: Jun. 25, 2024

(51) Int. Cl.

| | |
|---|---|
| ***A47B 96/02*** | (2006.01) |
| ***A47B 87/02*** | (2006.01) |
| ***A47B 96/14*** | (2006.01) |
| *A47G 29/087* | (2006.01) |

(52) U.S. Cl.
CPC ..... *A47B 96/02* (2013.01); *A47B 87/0246* (2013.01); *A47B 96/022* (2013.01); *A47B 96/14* (2013.01); *A47B 87/0207* (2013.01); *A47B 87/0223* (2013.01); *A47G 29/087* (2013.01)

(58) Field of Classification Search
CPC ..... A47B 96/14; A47B 96/02; A47B 96/022; A47B 61/00; A47B 96/16; A47B 47/00; A47B 47/0066; A47B 47/0075; A47B 47/0083; A47B 47/04; A47B 47/042; A47B 47/045; A47B 55/00; A47B 47/0091; A47B 2087/023; A47B 87/00; A47B 87/02; A47B 87/0207; A47B 87/0215; A47B 87/0223; A47B 87/0246; A47B 87/0253; A47G 29/087; A47F 2005/0012
See application file for complete search history.

(56) References Cited

U.S. PATENT DOCUMENTS

| | | | | | |
|---|---|---|---|---|---|
| 2,036,184 | A | * | 4/1936 | Armstrong | A47B 81/002 312/351 |
| D304,398 | S | * | 11/1989 | Goetz | D6/676.1 |
| 5,094,352 | A | * | 3/1992 | Green, Sr. | A47J 47/16 211/186 |
| D388,992 | S | * | 1/1998 | Weisburn | D6/562 |
| D406,713 | S | * | 3/1999 | Houk, Jr. | D6/705 |
| 5,881,653 | A | * | 3/1999 | Pfister | A47B 87/0223 211/188 |
| D409,868 | S | * | 5/1999 | France | D6/562 |
| 5,992,654 | A | * | 11/1999 | Dente, Jr. | A47B 96/022 211/90.01 |
| 6,264,220 | B1 | | 7/2001 | Pierce et al. | |
| D475,561 | S | * | 6/2003 | Suero, Jr. | D6/525 |
| 6,591,762 | B1 | * | 7/2003 | Haghayegh | A47B 96/022 108/42 |
| 6,908,000 | B2 | | 6/2005 | Craft et al. | |
| D654,745 | S | * | 2/2012 | Chuang | D6/562 |
| 8,733,563 | B2 | * | 5/2014 | Fadrowski | A47F 5/0025 211/144 |
| D713,181 | S | * | 9/2014 | Cohen | D6/676.1 |
| D819,362 | S | * | 6/2018 | Tee | D6/562 |
| D878,117 | S | * | 3/2020 | Gelman | D6/676.1 |

(Continued)

*Primary Examiner* — Devin K Barnett
(74) *Attorney, Agent, or Firm* — George L Williamson

(57) ABSTRACT

Apparatus and method for an improved corner shelf having a plurality of planar shelves supported on a plurality of legs wherein each leg has a raised leg on its lower end so that the lower shelf unit is disposed above and clear of the baseboard of the building. Each shelf is planar in nature being strengthened on its peripheral edges by a downwardly extending flange wherein a section of the downwardly extending flange comprises an enlarged vertical pegboard area having one-inch by one-inch spacings so that it can accommodate standard pegboard hooks including pegboard storage bins and is attached to either the drywall or to the studs in the wall of the building containing the apparatus.

12 Claims, 3 Drawing Sheets

(56) References Cited

U.S. PATENT DOCUMENTS

| | | | | | |
|---|---|---|---|---|---|
| D885,093 | S | * | 5/2020 | Gelman | D6/676.1 |
| D907,414 | S | * | 1/2021 | Li | D6/676.1 |
| 11,297,942 | B2 | * | 4/2022 | Walker | A47B 47/0083 |
| D950,988 | S | * | 5/2022 | Chen | D6/676.1 |
| D992,301 | S | * | 7/2023 | Cheng | D6/525 |
| D1,005,731 | S | * | 11/2023 | Gauni | D6/562 |
| D1,010,352 | S | * | 1/2024 | Amozoc | D6/562 |
| 11,925,154 | B1 | * | 3/2024 | Tinsley | A01G 31/06 |
| D1,021,464 | S | * | 4/2024 | Wei | D6/525 |
| D1,032,257 | S | * | 6/2024 | Ye | D6/676.1 |
| 12,070,124 | B2 | * | 8/2024 | Whitta | A47B 47/0083 |
| D1,051,645 | S | * | 11/2024 | Wei | D6/676.1 |
| 2003/0173321 | A1 | * | 9/2003 | Craft | A47B 49/006 211/144 |
| 2014/0263124 | A1 | * | 9/2014 | Tesdal | A47K 3/281 29/428 |

* cited by examiner

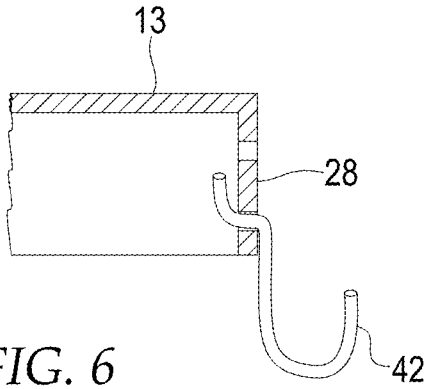
FIG. 6
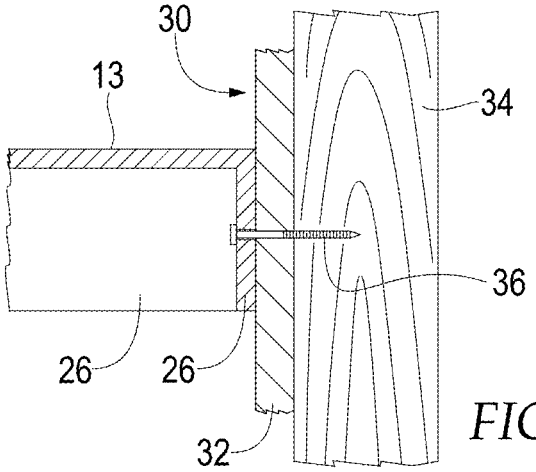
FIG. 7
FIG. 8
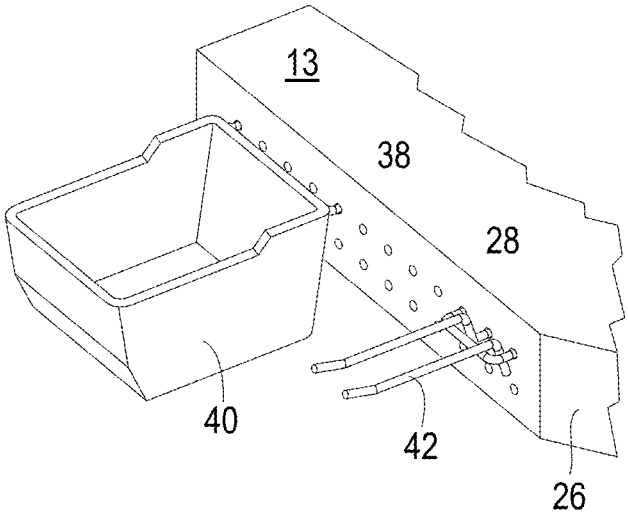
FIG. 9
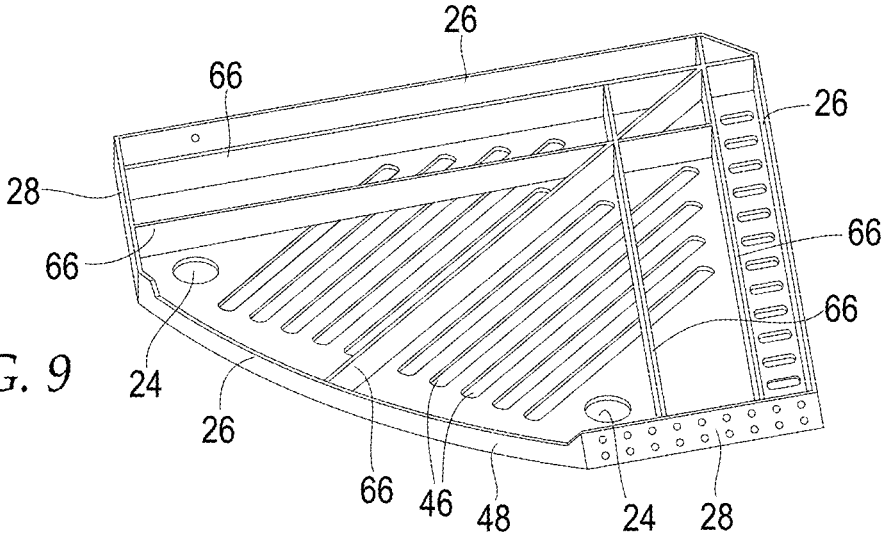

CORNER SHELF

PRIOR ART

Devices relevant to the present invention have been described in the related art; however, none of the related art devices disclose the unique features of the present invention.

In U.S. Pat. No. 5,094,352, dated Mar. 10, 1992, Green, Sr., et al., disclosed a portable rack for holding pots and pans and the like. In U.S. Pat. No. 8,733,563, dated May 27, 2014, Fadrowski, disclosed a display unit with interchangeable shelving. In U.S. Pat. No. 6,908,000, dated Jun. 21, 2005, Craft, et al., disclosed a multi-tiered corner shelving unit. In U.S. Pat. No. 11,297,942, dated Apr. 12, 2022, Walker, disclosed a shelving system. In U.S. Pat. No. 6,264,220, dated Jul. 24, 2001, Pierce, et al., disclosed a wheeled tool cart with removable tool holder tray.

While these devices may be suitable for the purposes for which they were designed, they would not be as suitable for the purposes of the present invention as hereinafter described. As will be shown by way of explanation and drawings, the present invention works in a novel manner and differently from the related art.

BACKGROUND OF THE INVENTION

The present invention relates generally to shelving systems and, more particularly, is concerned with a shelving system having a plurality of shelves with each shelf having a strengthened and enlarged vertical pegboard area on its peripheral edges.

SUMMARY OF THE INVENTION

The present invention discloses an improved corner shelf kit which is generally described as a shelf system made from resin or other materials similar to plastic-like materials for use in a garage, basement, storage room, laundry room or the like. The present invention comprises a corner shelf system having a plurality of planar shelves supported on a plurality of legs wherein each leg has a raised leg on its lower end so that the lower shelf unit is disposed above and clear of the baseboard of the building within which the present invention is placed. Each shelf of the present invention is planar in nature being strengthened on its peripheral edges by a downwardly extending flange wherein a section of the downwardly extending flange comprises an enlarged vertical pegboard area having one-inch by one-inch spacings so that it can accommodate standard pegboard hooks including pegboard storage bins. The enlarged vertical pegboard area is designed to accommodate many of the standard pegboard accessories that are currently on the market which allows the homeowner the opportunity to use the sides of the shelves to hang various items including brooms, tools, small parts, and the like. Furthermore, the present invention is attached to either the drywall or to the studs in the wall of the building housing the present invention.

An object of the present invention is to provide a shelving system made of resin or plastic-like materials so that it can be readily available to the general population. A further object of the present invention is to provide a shelving system which requires little hardware for assembly. A further object of the present invention is to provide a shelving system which can be securely attached to either the drywall or to the studs in the wall of the building housing the present invention. A further object of the present invention is to provide a shelving system which can be easily operated by a user. A further object of the present invention is to provide a shelving system which can be relatively easily and inexpensively manufactured.

The foregoing and other objects and advantages will appear from the description to follow. In the description reference is made to the accompanying drawings, which form a part hereof, and which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF DRAWINGS

In order that the invention may be more fully understood, it will now be described, by way of example, with reference to the accompanying drawings in which:

FIG. 6 is a cross sectional view of the present invention taken from FIG. 1 as indicated.

FIG. 7 is a cross sectional view of the present invention taken from FIG. 1 as indicated.

FIG. 8 is an enlarged perspective view of portions of the present invention.

FIG. 9 is a perspective view of an underside of a typical shelf of the present invention.

DETAILED DESCRIPTION OF THE INVENTION

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 8 illustrate the present invention wherein a shelving system for use on the inside of a building is disclosed and which is generally indicated by reference number 10.

Figure 1:
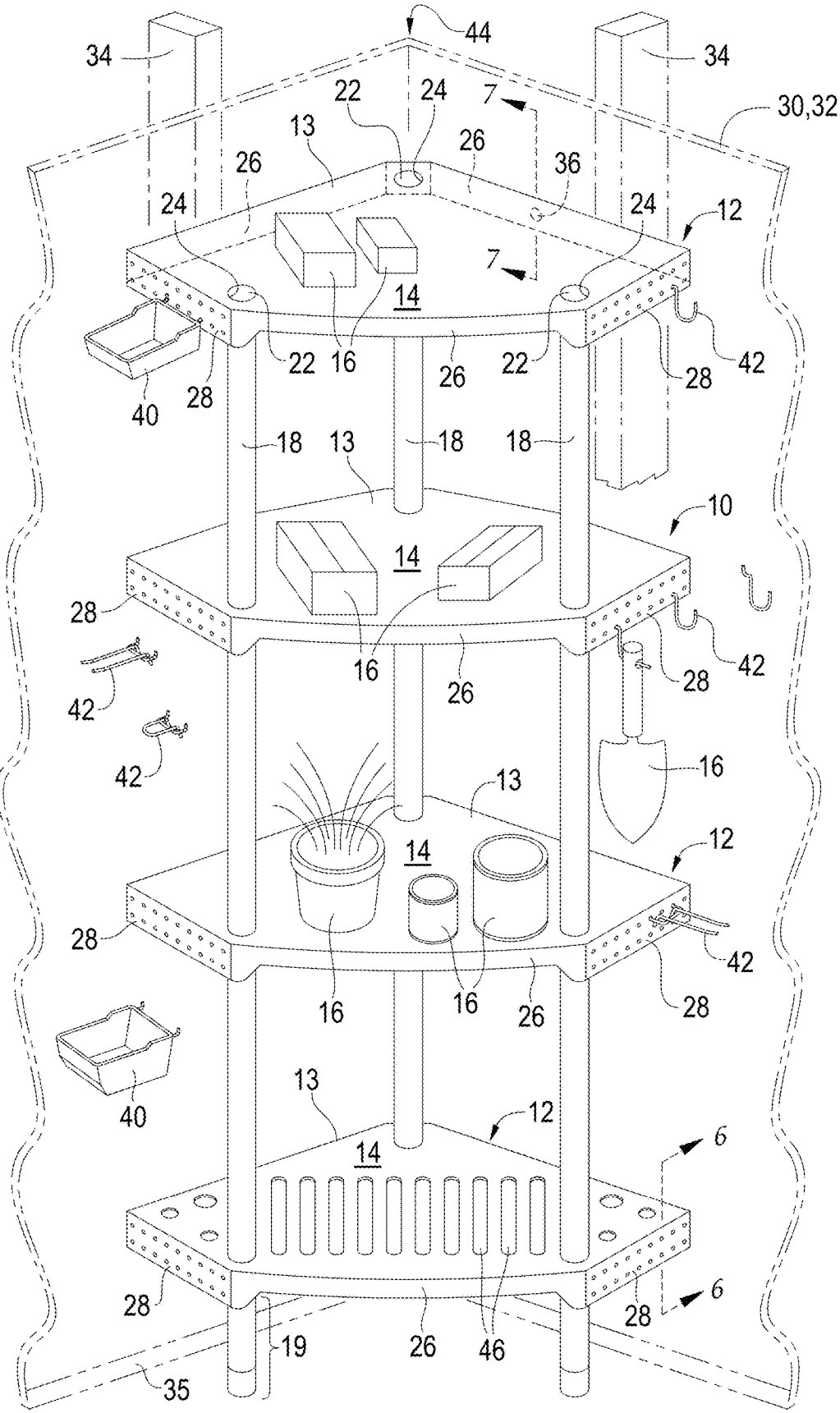
FIG. 1 is a perspective view of the present invention shown in operative connection.

Turning to FIG. 1, therein is shown a perspective view of the present invention 10 which is disposed or mounted on the inside of a building including a plurality of shelving system assemblies 12 shown disposed one above the other wherein each individual shelf 13 has an upper planar surface 14 upon which items can be placed. The items 16 may be any item which could be, for example and without limitation, laundry products, such as soap, tools, small parts, plants, paint, or any other product commonly used in a home or business. The shelving assemblies 12 each comprise an individual shelf 13 wherein each of the shelves is mounted on and supported by a plurality of legs 18 wherein each cylindrical shaped leg is flush at its top 22 with the planar surface of the shelf 13 and is extended through a circular socket 24 in the shelf 13 so that each shelf can be easily attached to each of the legs 18. Each leg 18 passes through a socket 24 so that each shelf 13 has a number of sockets which match the number of legs. Each leg 18 has a raised portion 19 on its lower end so that the lowest shelf 13 is raised above the baseboard 35 of the wall 30. For illustration purposes, FIG. 1 shows the present invention 10 having a total of four shelving assemblies 12 and three legs 18. Each shelf 13 needs to be strengthened structurally and made more rigid, therefore a downwardly extending peripheral flange 26 is provided on the outer peripheral edge of each shelf 13. Therefore, the flange 26 extends completely around the peripheral edges of the shelf 13 but includes an enlarged vertical pegboard area 28 disposed on its front and outboard edges so that the enlarged pegboard area 28 includes a perforated, vertical rigid pegboard area comprising a pegboard having a one-inch by one-inch pattern and being disposed vertically and in a coplanar fashion with the downwardly extending flange 26 which provides structural strengthening to shelf 13. Each shelving assembly 12 has its own individual enlarged pegboard area 28. The building housing the present invention 10 includes a wall 30, covered with sheetrock 32 and being supported on a plurality of 2×4 wall studs 34. The present invention 10 includes at least one fastener 36 which has passes through the downwardly extending flange 26 then through the sheetrock 32 and into the 2×4 wall stud 34 so that the present invention 10 is secured in an upstanding fashion to the wall 30 of the building housing the present invention.

Figure 4:
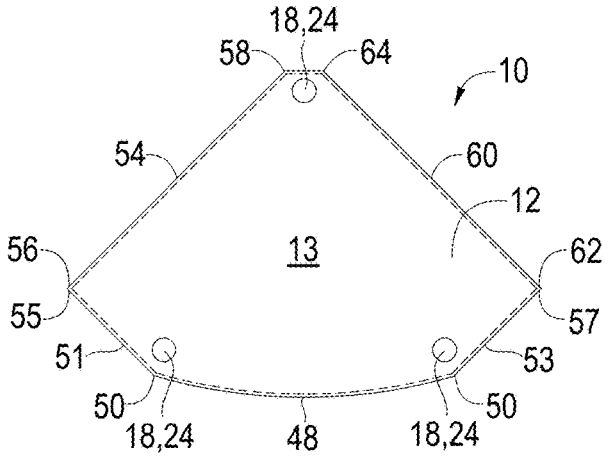
FIG. 4 is a top view of the present invention.
Figure 5:
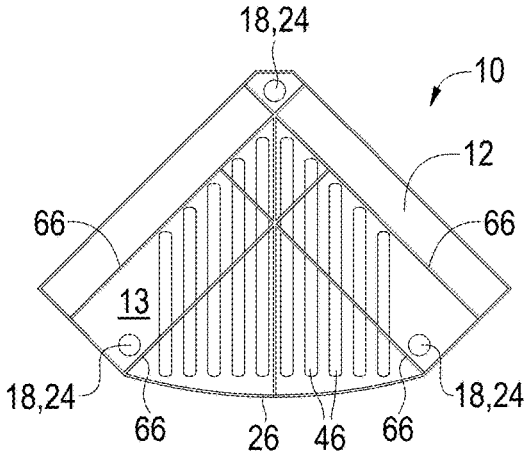
FIG. 5 is a bottom view of the upper shelf of the present invention.
Figure 2:
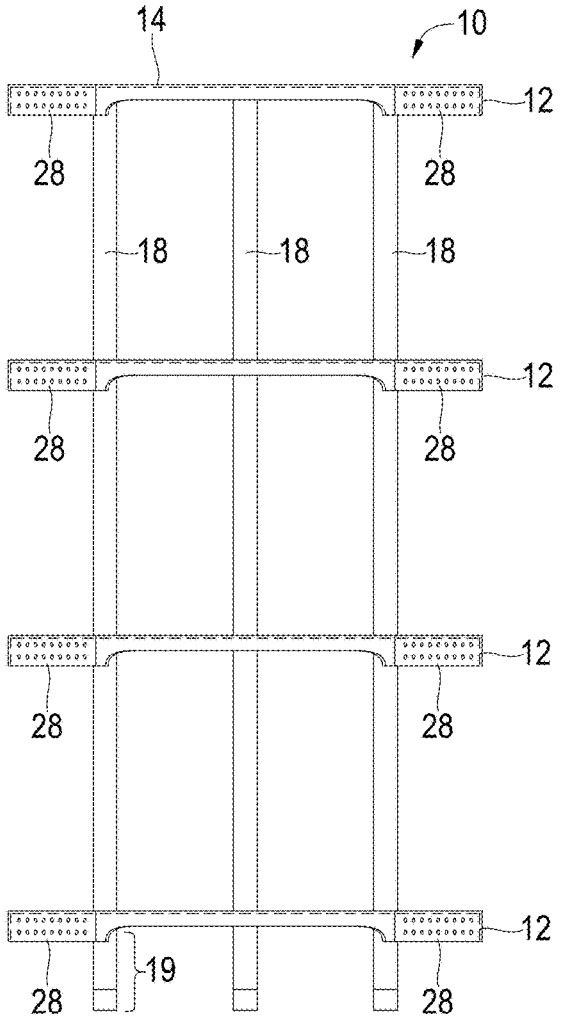
FIG. 2 is a front elevation view of the present invention.
Figure 3:
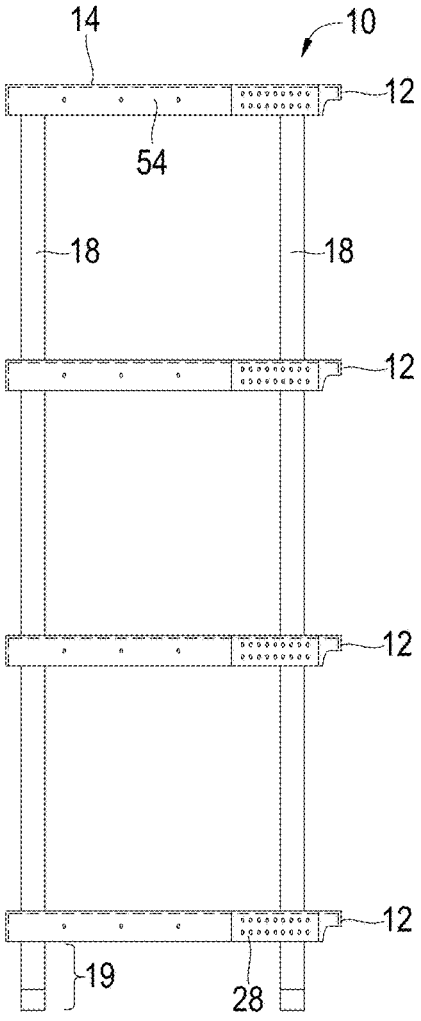
FIG. 3 is a side elevation view of the present invention.

Turning to FIGS. 2-5, therein are shown additional views of the present invention 10 showing previously disclosed elements. Turning particularly to FIG. 4, therein is shown shelf 13 with an front edge 48 (a portion of which is curved and a portion of which is straight) having first and second ends 50, 52 disposed between first and second straight end segments 51, 53 each having a distal end 55, 57, wherein the first and second straight end segments 51, 53 each comprise the peg board portion 28, and a left rear edge 54 having first and second ends 56, 58 and a right rear edge 60 having first and second ends 62, 64, wherein the first end 56 of the left rear edge 54 joins to the distal end 55 of the first straight end segment 51 and the first end 62 of the right rear edge 60 joins to the distal end 57 of the second straight end segment 53, and wherein the second ends 58, 64 of the left and right rear edges 54, 60 are joined to each other to permit placement in the corner 44 of the building. Turning particularly to FIG. 5, therein is shown several support ribs 66 running in various directions across the shelf wherein the ribs are vertically disposed underneath the shelf for adding structural strength for supporting items placed on top of the shelves. Also shown are sockets 24 with legs 18 along with the flange 26 running around the edge of the shelf 13. A plurality of slots 46 are also shown.

Turning to FIG. 6, therein is shown a portion of a single shelf 13 having a downwardly extending flange 26 along with the enlarged pegboard area 28 disposed along its peripheral edge comprising a 1 inch×1 inch pegboard pattern shown at 38 for receiving a pegboard storage bin 40 along with individual pegboard hooks 42.

Turning to FIG. 7, therein is shown shelf 13 and its flange 26 illustrating a fastener 36 passing through the flange 26, and then through the sheetrock/drywall 32, and into a 2"×4" wall stud 34 for securing the present invention 10 to the wall 30 in an upright position. Thus, the shelf 13 is attached to either the drywall 32 or stud 34.

Turning to FIG. 8, therein is shown a portion of a single shelf 13 having a downwardly extending flange 26 along with the enlarged pegboard 28 disposed along its peripheral edge comprising a 1"×1" pegboard pattern shown at 38 for receiving a pegboard storage bin 40 along with individual pegboard hooks 42.

Turning to FIG. 9, therein is shown an underside of a typical shelf 13 of the present invention 10 showing several support ribs 66 running in various directions across the shelf wherein the ribs are vertically disposed underneath the shelf for adding structural strength for supporting items placed on top of the shelves. Also shown are sockets 24 along with the flange 26 running around the edge of the shelf and the pegboard area 28 disposed proximate the ends of the front edge 48. A plurality of slots 46 are also shown.

The pegboard hole pattern, which is a 1"×1" grid hole pattern, is incorporated into a shelving assembly 12 and is specifically designed to accommodate common pegboard type accessories commonly sold in big box stores and other places. The hole pattern is a 1"×1" grid hole pattern 38 which is designed to accommodate standard pegboard hooks 42 and standard pegboard storage bins 40. The present invention 10 allows a consumer to install a shelving system, the present invention 10, and use a multitude of currently available standard hooks and trays which are available commercially in the market but would now be able to be attached to a shelving system so that they can be used to store tools and other various items in a garage or other areas of a home or business.

The present invention 10 could be described as a resin shelf system for use in a garage, basement, storage room or laundry room; and, no particular hardware is required for its assembly, and it is structurally secured to the studs 34 of the wall of the building using strong secure hardware. The present invention 10 can be assembled and installed in minutes and is ideal for corner spaces that are often unused and wasted space. The shelves 13 are expected to have a width of approximately 31" and a depth of approximately 22".

By way of summary and by making reference to FIGS. 1-9, the present invention 10 discloses a method of assembling an improved corner shelf for placement in a corner 44 of a building, comprising the steps of providing a plurality of shelves 13 arranged in a spaced apart vertically stacked arrangement, each shelf having a planar upper surface 14 disposed in substantially a horizontal plane, each shelf having an underside, each shelf having a plurality of sockets 24 therein, each shelf having at least one slot 46 therein and at least one peg board portion 28 for storing and organizing various items: also, as best seen in FIG. 4, providing each shelf 13 with an front edge 48 (a portion of which is curved and a portion of which is straight) having first and second ends 50, 52 disposed between first and second straight end segments 51, 53 each having a distal end 55, 57, wherein the first and second straight end segments 51, 53 each comprise the peg board portion 28, and a left rear edge 54 having first and second ends 56, 58 and a right rear edge 60 having first and second ends 62, 64, wherein the first end 56 of the left rear edge 54 joins to the distal end 55 of the first straight end segment 51 and the first end 62 of the right rear edge 60 joins to the distal end 57 of the second straight end segment 53, and wherein the second ends 58, 64 of the left and right rear edges 54, 60 are joined to each other to permit placement in the corner 44 of the building; also, providing a plurality of legs 18 each having upper and lower ends, wherein each leg passes through a corresponding socket 24 of each shelf, wherein the plurality of shelves are supported on the plurality of legs; also, providing a plurality of support ribs 66 disposed on the underside of the shelves; also, providing a downwardly extending flange 26 extending longitudinally along the front edge and the left and right rear edges, wherein the flange is substantially vertically disposed; also, wherein said peg board portion is disposed in a co-aligned relationship with the downwardly extending flange; and, wherein a first peg board portion is disposed proximate the first end of the arcuate front edge and a second peg board portion is disposed proximate the second end of the arcuate first edge. Furthermore, each peg board portion is arranged in a one-inch×one-inch pattern 38 to permit use of standard sized accessories 40, 42 and the plurality of sockets and the plurality of legs are the same diameter.

The invention claimed is:

1. A corner shelf system for placement in a corner of a building, comprising:

a) a plurality of shelves arranged in a spaced apart vertically stacked arrangement, each said shelf having a planar upper surface disposed in substantially a respective horizontal plane, each said shelf having an underside, each said shelf having a plurality of sockets therein, each said shelf having at least one slot therein and peg board portions for storing and organizing various items;

b) each said shelf having an arcuate front edge segment having first and second ends disposed between first and second straight end segments each having a distal end, wherein said first and second straight end segments each comprises a respective peg board portion from said peg board portions, a left rear edge having first and second ends and a right rear edge having first and second ends, wherein said first end of said left rear edge joins to said distal end of said first straight end segment and said first end of said right rear edge joins to said distal end of said second straight end segment, and wherein said second ends of said left and right rear edges are joined to permit placement in the corner of the building;

c) a plurality of legs each having upper and lower ends, wherein each leg passes through a corresponding socket from the plurality of sockets of each said shelf, wherein said plurality of shelves are supported on said plurality of legs;

d) a plurality of support ribs disposed on said underside of each shelf;

e) a downwardly extending flange extending longitudinally along said arcuate front edge and said left and right rear edges of each shelf, wherein each flange is substantially vertically disposed;

f) wherein said peg board portions are disposed in a co-aligned relationship with said downwardly extending flange for each shelf; and g) wherein a respective first pegboard portion from said peg board portions is disposed proximate said first end of said arcuate front edge and a respective second pegboard portion from said peg board portions is disposed proximate said second end of said arcuate front edge.

2. The corner shelf system of claim 1, wherein each said pegboard portion is arranged in a one inch×one-inch pattern to permit use of standard sized accessories.

3. The corner shelf system of claim 1, wherein said plurality of sockets and said plurality of legs are the same diameter.

4. The corner shelf system of claim 1, wherein the corner shelf system is disposed in the corner of the building, the building having a wall proximate the corner shelf system.

5. The corner shelf system of claim 4, wherein a corresponding lowest shelf from said plurality of shelves is disposed above a baseboard of the wall of the building.

6. The corner shelf system of claim 5, wherein at least one shelf from the plurality of shelves is secured to said wall of the building.

7. A method of assembling a corner shelf for placement in a corner of a building, comprising the steps of:

a) providing a plurality of shelves arranged in a spaced apart vertically stacked arrangement, each shelf having a planar upper surface disposed in substantially a respective horizontal plane, each shelf having an underside, each shelf having a plurality of sockets therein, each shelf having at least one slot therein and at least one peg board portion for storing and organizing various items;

b) providing each shelf with an arcuate front edge segment having first and second ends disposed between first and second straight end segments each having a distal end wherein the first and second straight end segments each comprise a respective peg board portion from said at least one peg board portion, a left rear edge having first and second ends and a right rear edge having first and second ends, wherein the first end of the left rear edge joins to the distal end of the first straight end segment and the first end of the right rear edge joins to the distal end of the second straight end segment, and wherein the second ends of the left and right rear edges are joined to permit placement in the corner of the building;

c) providing a plurality of legs each having upper and lower ends, inserting each leg passes through a corresponding socket from the plurality of sockets of each shelf, wherein the plurality of shelves are supported on the plurality of legs;

d) providing a plurality of support ribs disposed on the underside of each shelf;

e) providing a downwardly extending flange extending longitudinally along the arcuate front edge and the left and right rear edges of each shelf, wherein each flange is substantially vertically disposed;

f) wherein each peg board portion is disposed in a co-aligned relationship with the downwardly extending flange for each shelf; and g) wherein a respective first peg board portion from said at least one peg board portion is disposed proximate the first end of the arcuate front edge and a respective second peg board portion from said at least one peg board portion is disposed proximate the second end of the arcuate first front edge.

8. The method of claim 7, wherein each peg board portion is arranged in a one-inch×one-inch pattern to permit use of standard sized accessories.

9. The method of claim 7, wherein the plurality of sockets and the plurality of legs are the same diameter.

10. The method of claim 7, wherein the corner shelf system is disposed in the corner of the building, the building having a wall proximate the corner shelf system.

11. The method of claim 10, wherein a corresponding lowest shelf from said plurality of shelves is disposed above a baseboard of the wall of the building.

12. The method of claim 11, wherein at least one shelf from the plurality of shelves is secured to the wall of the building.

* * * * *